US008631580B2

(12) United States Patent
Randall et al.

(10) Patent No.: US 8,631,580 B2
(45) Date of Patent: Jan. 21, 2014

(54) LIFT ARM ASSEMBLY

(75) Inventors: Kort Christopher Randall, Peoria, IL (US); Balasubramanyam Appalla, Peoria, IL (US); Dale Michael Koch, Tremont, IL (US); Matthew Mark Robinson, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 894 days.

(21) Appl. No.: 12/794,586

(22) Filed: Jun. 4, 2010

(65) Prior Publication Data

US 2011/0299965 A1 Dec. 8, 2011

(51) Int. Cl.
*B21D 53/88* (2006.01)

(52) U.S. Cl.
USPC ..... 29/897.2; 414/685; 414/722; 414/815

(58) Field of Classification Search
USPC ..... 414/722, 727, 685, 815; 29/897.2; 403/268, 270, 292, 294, 313, 361
See application file for complete search history.

(56) References Cited

U.S. PATENT DOCUMENTS

| | | | | |
|---|---|---|---|---|
| 3,722,864 | A | | 3/1973 | Borer et al. |
| 4,060,261 | A | | 11/1977 | Bauer et al. |
| 4,159,796 | A | | 7/1979 | Braithwaite |
| 4,260,322 | A | | 4/1981 | Cameron |
| 4,295,779 | A | * | 10/1981 | Shumaker ..... 414/685 |
| 4,904,151 | A | | 2/1990 | Biemans et al. |
| 5,609,464 | A | | 3/1997 | Moffitt et al. |
| 5,611,657 | A | | 3/1997 | Peterson |
| 6,106,217 | A | * | 8/2000 | Knell ..... 414/722 |
| 6,109,858 | A | | 8/2000 | Deneve et al. |
| 6,132,163 | A | | 10/2000 | Andrews et al. |
| 6,171,050 | B1 | | 1/2001 | Johnson |
| D469,448 | S | | 1/2003 | Bares et al. |
| 6,572,323 | B2 | | 6/2003 | Schupback |
| 6,616,398 | B2 | | 9/2003 | Dershem et al. |
| 6,695,568 | B2 | | 2/2004 | Bares et al. |
| 6,796,762 | B2 | | 9/2004 | Vicars, III et al. |
| 6,832,659 | B1 | | 12/2004 | Bares et al. |

(Continued)

FOREIGN PATENT DOCUMENTS

| | | |
|---|---|---|
| JP | 2003261956 | 9/2003 |
| JP | 2007-254986 | 10/2007 |

OTHER PUBLICATIONS

J C Bamford Excavators Ltd, "JCB: Skid Steer Loaders," http://www.jcb.com/products/MachineOverview.aspx?RID=12, retrieved on May 24, 2010 (1 page).

*Primary Examiner* — Scott Lowe
(74) *Attorney, Agent, or Firm* — Finnegan, Henderson, Farabow, Garrett & Dunner LLP

(57) ABSTRACT

A lift arm assembly includes a first arm casting including a first end, a second arm casting including a first end, and a tubular cross member attached to the first arm casting and the second arm casting. The lift arm assembly also includes a first arm tubular member including a first end attached to the first end of the first arm casting. The lift arm assembly further includes a second arm tubular member including a first end attached to the first end of the second arm casting such that the second arm tubular member is generally parallel to the first arm tubular member. At least one of the tubular cross member, the first arm tubular member, or the second arm tubular member has a continuous periphery, a maximum of one seam, and a substantially constant cross-section along substantially an entire length of the respective member.

19 Claims, 3 Drawing Sheets

(56) References Cited

U.S. PATENT DOCUMENTS

| | | | |
|---|---|---|---|
| 7,264,435 | B2 | 9/2007 | Layko et al. |
| D583,835 | S | 12/2008 | Sugiyama et al. |
| 2002/0064445 | A1 | 5/2002 | Dershem et al. |
| 2004/0115036 | A1 | 6/2004 | Roan et al. |
| 2009/0220328 | A1 | 9/2009 | Satou |
| 2009/0252588 | A1 | 10/2009 | Satou |

* cited by examiner

LIFT ARM ASSEMBLY

TECHNICAL FIELD

The present disclosure relates generally to a lift arm assembly, and more particularly, to a lift arm assembly for a skid steer loader or other machine.

BACKGROUND

Various machines include implements that are raised and lowered to perform desired tasks. For example, machines like skid steer loaders may include a bucket, fork, or other implement that is raised and lowered to assist in transferring material between desired locations. In many cases, such implements are coupled to a frame of the machine by a lift arm assembly that serves to control the movement of the implement between the lowered and raised positions.

FIG. 1 shows a conventional skid steer loader 100 including a lift arm assembly 110. The conventional lift arm assembly 110 may include two arms 112 pivotably coupled to a frame 120 of the skid steer loader 100. An implement 130 may be connected to the front ends of the arms 112. An actuator 140 may be connected at one end to the lift arm assembly 110 and at another end to the frame 120. The actuator 140 may be controlled to rotate the lift arm assembly 110 about the pivot connection between the arms 112 and the frame 120, thereby moving the implement 130 between raised and lowered positions.

The conventional lift arm assembly 110 may be heavy, and costly and difficult to assemble. For example, a pair of lift arms for a skid steer loader is described in Japanese Patent Publication No. JP 2007-254986 ("the JP986 publication") to Endo et al. The JP986 patent describes a pair of lift arms that include portions that are formed out of sheet metal or plate steel, and portions that are formed of cast steel. The portions that are formed from plate steel are formed by bending and welding together two or more sections of plate steel to form an arm with a cross-section that tapers along the length of the arm. The plate steel is cut into complex shapes to form the various features provided on the lift arms, such as portions for connecting to the hydraulic cylinders that control the movement of the lift arms. Also, the sections of plate steel for each lift arm form a seam where the sections of plate steel are joined and welded along the length of each lift arm. As a result, the lift arms of the JP986 publication that are formed from plate steel are heavier due to the weight and greater total length of the welds, and are more costly and difficult to assemble.

The disclosed lift arm assembly is directed to overcoming one or more of the problems set forth above.

SUMMARY

In one aspect, the present disclosure is directed to a lift arm assembly. The lift arm assembly includes a first arm casting including a first end, a second arm casting including a first end, and a tubular cross member attached to the first arm casting and the second arm casting. The lift arm assembly also includes a first arm tubular member including a first end attached to the first end of the first arm casting. The lift arm assembly further includes a second arm tubular member including a first end attached to the first end of the second arm casting such that the second arm tubular member is generally parallel to the first arm tubular member. At least one of the tubular cross member, the first arm tubular member, or the second arm tubular member has a continuous periphery, a maximum of one seam, and a substantially constant cross-section along substantially an entire length of the respective member.

In another aspect, the present disclosure is directed to a method of assembling a lift arm assembly. The method includes attaching a first end of a tubular cross member to a first arm casting, attaching a second end of the tubular cross member to a second arm casting, attaching a first arm tubular member to the first arm casting, and attaching a second arm tubular member to the second arm casting such that the second arm tubular member is generally parallel to the first arm tubular member. The method also includes inserting at least a portion of one of the first arm tubular member and the first arm casting into the other of the first arm tubular member and the first arm casting, and inserting at least a portion of one of the second arm tubular member and the second arm casting into the other of the second arm tubular member and the second arm casting.

In a further aspect, the present disclosure is directed to a machine including a frame and a lift arm assembly pivotally coupled to the frame. The lift arm assembly includes a first casting and a first tubular member including a first end attached to the first casting. The first tubular member has a continuous periphery and a substantially constant cross-section along substantially an entire length of the first tubular member. The machine also includes an implement coupled to the first casting.

DETAILED DESCRIPTION

Reference will now be made in detail to exemplary embodiments of the invention, examples of which are illustrated in the accompanying drawings. Wherever possible, the same reference numbers will be used throughout the drawings to refer to the same or like parts.

Figure 1:
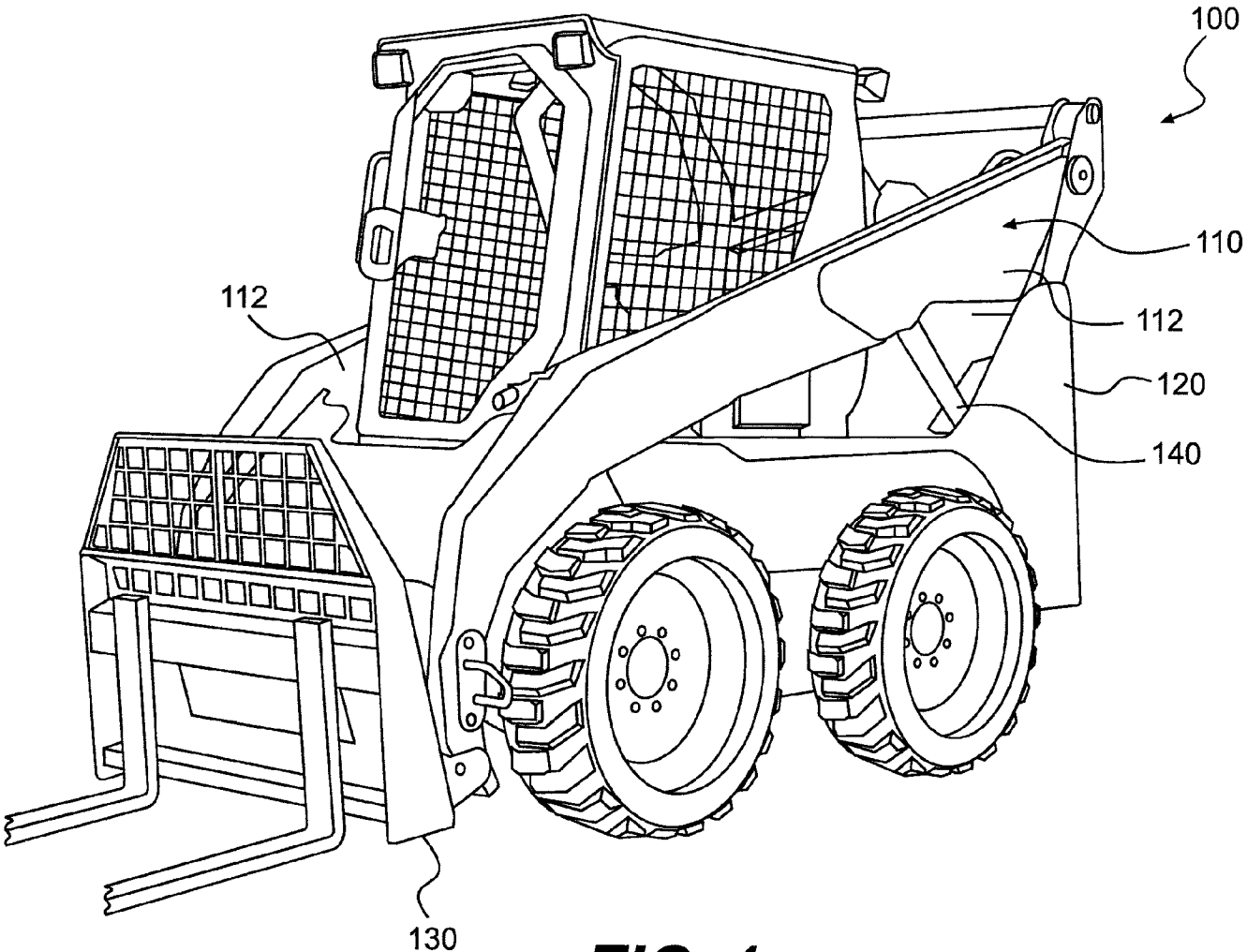
FIG. 1 PRIOR ART
FIG. 1 is a perspective view of a conventional skid steer loader.
Figure 2:
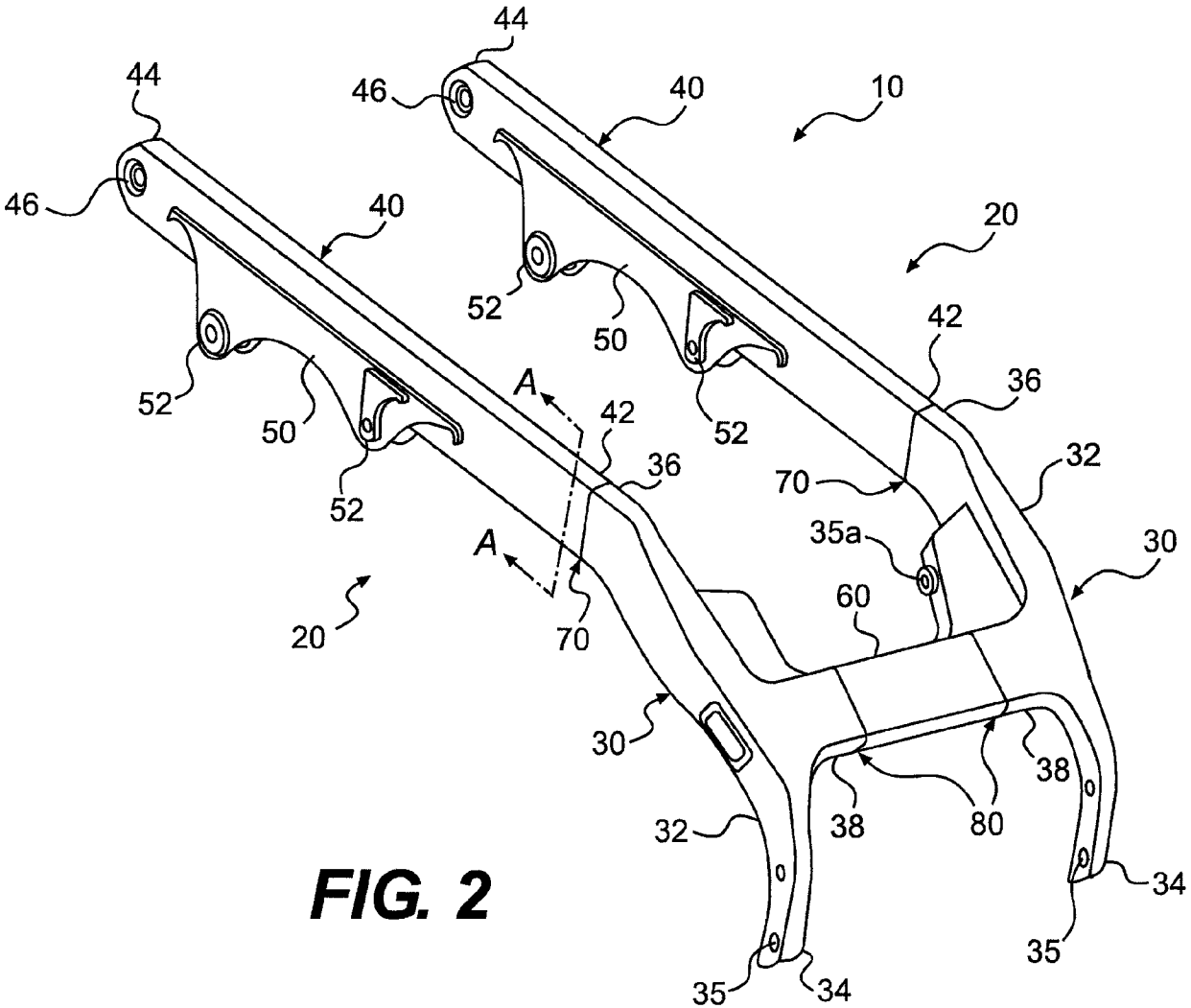
FIG. 2 is a perspective view of a lift arm assembly for a machine, according to an exemplary embodiment.

FIG. 2 illustrates a lift arm assembly 10 for an exemplary machine (not shown) having multiple systems and components that cooperate to accomplish a task. The machine may be a fixed or mobile machine that performs some type of operation associated with an industry such as mining, construction, farming, transportation, or any other industry known in the art. For example, the machine may be an earth moving machine such as an excavator, a dozer, a loader, a backhoe, a motor grader, a dump truck, or any other earth moving machine. In an exemplary embodiment, the machine may be a skid steer loader (SSL) similar to the skid steer loader shown in FIG. 1. Alternatively, the machine may be a multi-terrain loader (MTL) or a compact track loader (CTL).

The machine may include an implement, such as a bucket, fork, or other tool used to perform a task.

The terms "front" and "rear" are used herein to refer to the relative positions of the components of the exemplary lift arm assembly 10. When used herein, "front" refers to one end of the lift arm assembly 10, e.g. positioned at or near the forward end of the machine with respect to the direction of travel of the machine. The front end of the lift arm assembly 10 may also be the end that is connected to or proximal to the implement of the machine. In contrast, "rear" refers to an end of the lift arm assembly 10 that is opposite the front end. The rear end of the lift arm assembly 10 may be positioned at or near the rearward end of the machine with respect to the direction of travel of the machine. In an alternate embodiment, the front end of the lift arm assembly 10 as described herein may be positioned at or near the rearward end of the machine, or at other locations on the machine, and the rear end of the lift arm assembly 10 as described herein may be positioned at or near the forward end of the machine, or at other locations on the machine.

The term "longitudinal" refers to a dimension or plane generally extending between the front and rear ends of the lift arm assembly 10. The term "lateral" refers to a dimension or plane generally extending perpendicular to the longitudinal dimension or plane.

The lift arm assembly 10 includes a pair of arms 20 that are connected together by a cross member 60. Each arm 20 extends generally longitudinally and parallel to each other. The cross member 60 connects the arms 20 together and extends generally laterally between the arms 20. The cross member 60 may be a tubular member, as described below.

Each arm 20 includes a casting 30 located toward a front end of the respective arm 20, and a tubular member 40 located toward a rear end of the respective arm 20. In an exemplary embodiment, one of the arms 20 is positioned generally closer to a right side of the machine with respect to the direction of travel of the machine, and therefore includes a right arm casting 30 and a right arm tubular member 40. The other arm 20 is positioned generally closer to a left side of the machine with respect to the direction of travel of the machine, and therefore includes a left arm casting 30 and a left arm tubular member 40. The left arm casting 30 and left arm tubular member 40 may be identical to the respective right arm casting 30 and right arm tubular member 40. Also, the respective castings 30 and tubular members 40 may be positioned so that they mirror each other with respect to a plane intersecting the middle of the cross member 60, as shown in FIG. 2.

Each casting 30 may be formed as a single integral and/or continuous part using casting techniques known in the art, e.g., by pouring liquid metal into a mold or other cavity to form a desired shape and allowing the metal to solidify into the desired shape. Alternatively, the castings 30 may be formed using other techniques for forming single integral and/or continuous parts. The castings 30 may be formed uniformly of a single material, such as a metal, metal alloy, or other like material. For example, the castings 30 may be formed of cast steel. Alternatively, the castings 30 may be formed of more than one material, but as a single integral and/or continuous part, e.g., a single part including a layer or coating applied to an outer surface of the part. The castings 30 may be solid or at least partially hollow.

Each casting 30 includes a main section 32 that extends generally longitudinally and parallel to each other, and includes a front end 34 and a rear end 36. Each casting 30 also includes a middle section 38 that extends generally laterally from a location of the main section between the front and rear ends 34, 36. The main section 32 and the middle section 38 are integrally formed in a single casting.

The front end 34 of each casting 30 may include one or more openings 35 configured to connect to a corresponding pin connection or other connecting element of the implement described above, such as a bucket, fork, or other tool. One or more openings 35 of each casting 30 may connect to the same implement. Alternatively, instead of the opening 35, the front end 34 of the casting 30 may include a pin connection or other connecting element configured to join to a feature of the implement. As a result, the front ends 34 of the castings 30 may be connected to the implement so that the lift arm assembly 10 may operate to lift the implement. Additionally, the castings 30 may include another opening **35*a* (or pin connection or other connecting element) for connecting to a hydraulic cylinder (not shown) or other actuator. The hydraulic cylinder may be pivotally connected at one end to the casting 30 via the opening 35*a* and pivotally connected at another end to the implement. The hydraulic cylinder may be actuated to adjust an angular position of the implement in relation to the lift arm assembly 10**.

Each tubular member 40 extends generally longitudinally and parallel to each other, and includes a front end 42 and a rear end 44. The tubular members 40 and the cross member 60 may have substantially identical cross-sections. Each of the tubular members 40 and the cross member 60 may be formed as a single integral and/or continuous part. In the exemplary embodiment, each of the tubular members 40 and the cross member 60 includes a substantially constant cross-section along the length of the respective member 40, 60, and a continuous periphery. Thus, each of the tubular members 40 and the cross member 60 may be formed using the same fabrication methods, e.g., extrusion, bending and welding, or other techniques known in the art for forming parts of a fixed cross-sectional profile and/or having a continuous periphery, e.g., formed from the same size pipe stock.

Figure 3:
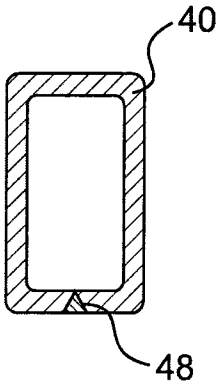
FIG. 3 is a cross-sectional view taken along the line A-A of FIG. 2 of a tubular member of the lift arm assembly, according to an exemplary embodiment.

FIG. 3 illustrates the cross-section of the tubular member 40 according to an exemplary embodiment taken along the line A-A shown in FIG. 2. The tubular member 40 shown in FIG. 3 may be formed by bending a piece of plate steel (or other material formed as a plate) and welding the ends of the piece of plate steel together to form a single weld 48. The weld 48 may be located on the bottom surface, as shown in FIG. 3. Alternatively, the weld 48 may be located on one of the side surfaces or on the top surface of the tubular member 40. The combination of the weld 48 and the bent piece of plate steel may form a continuous periphery, as shown in FIG. 2. Also, the tubular member 40 may be formed using this bending and welding process so that the tubular member 40 has a fixed cross-sectional profile and a substantially constant cross-section along substantially an entire length of the tubular member 40. Alternatively, the tubular member 40 may have a continuous periphery with more than one longitudinal weld.

Figure 4:
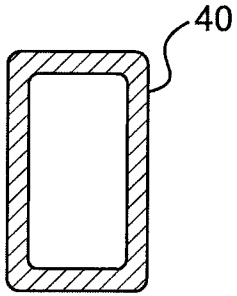
FIG. 4 is a cross-sectional view taken along the line A-A of FIG. 2 of a tubular member of the lift arm assembly, according to another exemplary embodiment.

FIG. 4 illustrates the cross-section of the tubular member 40 taken along the line A-A shown in FIG. 2, according to another exemplary embodiment. The tubular member 40 shown in FIG. 4 may be formed by extrusion or other process for forming a continuous and seamless periphery, e.g., pipe stock. For example, during extrusion, a material is pushed or drawn through a die to create a desired cross-section. The tubular member 40 may be formed using this process with a fixed cross-sectional profile and a substantially constant cross-section along substantially an entire length of the tubular member 40. The cross member 60 may have an identical or similar cross-section as the tubular members 40. As shown in FIGS. 3 and 4, the cross-sections of the tubular members 40 and the cross member 60 may be rectangular. Alternatively, the cross-sections may form other shapes, such as a circle, oval, square, or other polygon. For example, the cross-section of the tubular members 40 and the cross member 60 may be approximately 3 inches by approximately 9 inches, and may have a thickness of approximately 0.375 inches. The tubular members 40 and the cross member 60 may be formed of steel or other like materials.

The rear end 44 of each tubular member 40 may be rounded (as shown in FIG. 2) or flat. Also, the rear end 44 of each tubular member 40 may include an opening 46 configured to connect to the frame of the machine. For example, an axle, pin connection, or other connecting element may be inserted into the opening 46 to allow the lift arm assembly 10 to pivot about the opening 46. Alternatively, instead of the opening 46, the rear end 44 of each tubular member 40 may include a pin connection or other connecting element configured to join to a corresponding opening on the frame of the machine.

A plate assembly 50 or doubler assembly may be connected to each tubular member 40, as shown in FIG. 2. For example, the plate assembly 50 may include one or more plates, e.g., formed of plate steel or other materials, that may be connected to the tubular member 40. As shown in FIG. 2, each plate assembly 50 may include a plate welded or otherwise connected to each side of the tubular member 40, e.g., one side facing outward from the lift arm assembly 10 away from the opposite tubular member 40 and the other side facing inward toward the opposite tubular member 40. Alternatively, a plate assembly of a different configuration than the one shown in FIG. 2 may be welded or otherwise connected to each tubular member 40. The plate assembly may be configured, for example, depending on the configuration of linkages for connecting to the lift arm assembly 10 to the frame of the machine, the desired movement of the lift arm assembly 10, etc. Accordingly, the lift assembly 10 may be customized for a particular application or machine depending on the type of doubler assembly that is welded or otherwise connected to the tubular members 40.

Each plate of the plate assembly 50 may include one or more openings 52 that may include bar stock pin supports configured to connect to another feature of the machine. For example, a hydraulic cylinder (not shown) or other actuator may include one end that is pivotally connected to one of the openings 52, e.g., using a pin connection or other connecting element, and another end that is pivotally connected to the frame of the machine. The hydraulic cylinder may be actuated to cause the lift arm assembly 10 to pivot about the connection to the machine at the openings 46 in the tubular members 40. In an embodiment with a single opening 52 (corresponding to a single opening in each plate of the plate assembly 50), the opening 52 may pivotally connect to the hydraulic cylinder. For an embodiment with two openings 52, as shown in FIG. 2 (corresponding to two openings in each plate of the plate assembly 50), the pair of openings 52 may be positioned at different locations longitudinally along the plate assembly 50 so that one of the openings 52 may pivotally connect to the hydraulic cylinder and the other opening 52 may pivotally connect to a link that is also pivotally connected to the frame of the machine. Alternatively or in addition to including one or more openings 52, the plate assembly 50 may include pin connections or other types of connecting elements.

The plate assembly 50 may be connected to the respective tubular members 40 at a location between the front end 42 and rear end 44 of the tubular member 40, and the location may be determined based on, for example, the desired pivotal motion of the lift arm assembly 10 due to the hydraulic cylinder. The location may also be determined based on a stress (e.g., fatigue life) analysis of the lift arm assembly 10 so that the plate assembly 50 may be welded or otherwise connected to the respective tubular member 40 at a location that is less likely to result in mechanical failure due to fatigue, etc., as described below.

Figure 5:
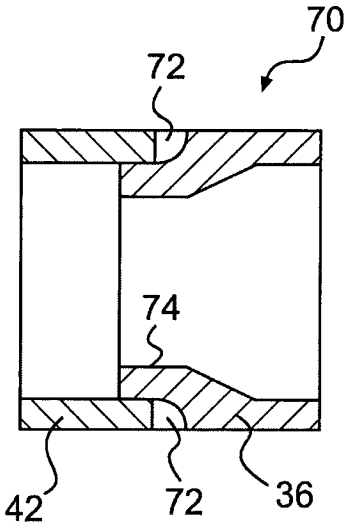
FIG. 5 is a cross-sectional view of the connection between the tubular member and a casting of the exemplary disclosed lift arm assembly of FIG. 2.

The front end 42 of each tubular member 40 may be welded or otherwise attached to the respective rear end 36 of the casting 30 on the corresponding left or right side of the lift arm assembly 10 to form a connection section 70 (FIGS. 2 and 5). FIG. 5 illustrates a cross-sectional view of the front end 42 of the tubular member 40 and the rear end 36 of the casting 30 in each connection section 70. The cross-sectional view of the connection section 70, as shown in FIG. 5, may be generally similar when taken along a longitudinal plane (a plane intersecting the top and bottom of the tubular member 40) or a plane transverse to the longitudinal plane (a plane intersecting the sides of the tubular member 40). As shown in FIG. 5, the rear end 36 of each casting 30 may include a necked portion 74 formed integrally with the casting 30.

The necked portion 74 is sized to be inserted into the front end 42 of the tubular member 40. For example, the cross-section of the necked portion 74 may be generally rectangular and smaller in length and width than the rectangular cross-section of the portion of the rear end 36 of the casting 30 adjacent the necked portion 74. The necked portion 74 may also form a groove 72 between the front end 42 of the tubular member 40 and an outer surface of the necked portion 74. As shown in FIG. 5, the groove 72 may be a J-groove since the profile of the outer surface of the necked portion 74 forms a curve generally in the form of a "J." The rear end 36 of the casting 30 may be attached to the front end 42 of the tubular member 40 by filling the groove 72 with a filler material and welding the parts together with a J-groove weld. Alternatively, instead of a J-groove weld, other types of welds or methods for joining two members may be used. The portion (with the larger cross-section) of the rear end 36 of the casting 30 adjacent the necked portion 74 may have an outer surface that is generally flush with the outer surface of the front end 42 of the tubular member 40, as shown in FIG. 5. Accordingly, there may be a generally flat transition between the weld (in the J-groove) and the outer surfaces of the rear end 36 of the casting 30 and the front end 42 of the tubular member 40.

In an alternative embodiment, the necked portion 74 may be formed in the front end 42 of the tubular member 40 so that the necked portion 74 is inserted into the rear end 36 of the casting 30. Then, the front end 42 of the tubular member 40 and the rear end 36 of the casting 30 may be welded together (e.g., with a J-groove weld) or otherwise joined as described above.

Figure 6:
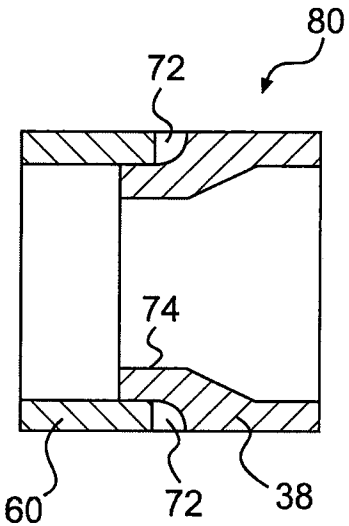
FIG. 6 is a cross-sectional view of the connection between a cross member and the casting of the exemplary disclosed lift arm assembly of FIG. 2.

A similar connection may be provided between each of the castings 30 and the respective ends of the cross member 60. For example, the ends of the cross member 60 may attach to the respective middle sections 38 of each casting 30 on the corresponding left or right side of the lift arm assembly 10 to form a connection section 80 (FIGS. 2 and 6). FIG. 6 illustrates a cross-sectional view of one of the ends of the cross member 60 and the respective middle section 38 of the casting 30 in each connection section 80. As shown in FIG. 6, the end of the middle section 38 of each casting 30 may include the necked portion 74 as described above, which may be formed integrally with the casting 30. The cross-sectional view of the connection section 80, as shown in FIG. 6, may be generally similar when taken along a plane intersecting the top and bottom of the cross member 60 or a plane intersecting the sides of the cross member 60. As shown in FIG. 6, the middle section 38 of each casting 30 may include the necked portion 74 formed integrally with the casting 30.

The necked portion 74 is sized to be inserted into the corresponding end of the cross member 60. For example, the cross-section of the necked portion 74 may be generally rectangular and smaller in length and width than the rectangular cross-section of the portion of the middle section 38 of the casting 30 adjacent the necked portion 74. The necked portion 74 may also form the groove 72 between the corresponding end of the cross member 60 and an outer surface of the necked portion 74. As shown in FIG. 6, the groove 72 may be a J-groove since the profile of the outer surface of the necked portion 74 forms a curve generally in the form of a "J." The middle section 38 of the casting 30 may be attached to the corresponding end of the cross member 60 by filling the groove 72 with a filler material and welding the parts together with a J-groove weld. Alternatively, instead of a J-groove weld, other types of welds or methods for joining two members may be used. The portion (with the larger cross-section) of the middle section 38 of the casting 30 adjacent the necked portion 74 may have an outer surface that is generally flush with the outer surface of the corresponding end of the cross member 60, as shown in FIG. 6. Accordingly, there may be a generally flat transition between the weld (in the J-groove) and the outer surfaces of the middle section 38 of the casting 30 and the end of the cross member 60.

Alternatively, the necked portion 74 may be formed in the end of the cross member 60 so that the necked portion 74 is inserted into the middle section 38 of the casting 30. Then, the end of the cross member 60 and the middle section 38 of the casting 30 may be welded together (e.g., with a J-groove weld) or otherwise joined as described above.

In an alternative embodiment, the lift arm assembly may include a single arm 20 that that includes only one tubular member 40 and only one casting 30. In such an embodiment, the middle section 38 may be omitted from the casting 30.

In another alternative embodiment, the lift arm assembly may include two arms 20, each including one tubular member 40, but the two tubular members 40 may be connected by a single casting. In such an embodiment, the cross member 60 may be omitted, and the castings 30 and the cross member 60 may be replaced by the single casting. The shape of the outer surface of the single casting may be similar to the shape of the outer surface of the castings 30 and cross member 60, and the connection sections 80 may be omitted.

INDUSTRIAL APPLICABILITY

The disclosed lift arm assembly may be applicable to any machine that includes at least one lift arm, e.g., for lifting a bucket, fork, or other implement. One or more advantages over the prior art may be associated with the exemplary lift arm assembly. For example, the disclosed lift arm assembly may be lighter and more durable, may be less expensive and easier to fabricate and assemble, may require less investment in terms of equipment, floor space, and manpower for fabrication and assembly, may include fewer parts, and may include fewer welds and a lower total length of welds.

The tubular members 40 and the cross member 60 may be formed using the same methods and equipment, e.g., using the same pipe stock, since these members 40, 60 may have substantially the same cross-section. For example, in the exemplary embodiment shown in FIG. 2, the tubular members 40 (which may be similar or identical to each other) may be formed from the same basic tubing or pipe stock, but may differ from the cross member 60 in length, the opening 45 at the rear end 44 of the tubular members 40, and the optional rounding of the rear end 44 of the tubular members 40. As a result, fabricating the tubular members 40 and the cross member 60 may be less expensive and may require fewer steps. Also, fabricating the tubular members 40 and the cross member 60 may require less investment in terms of equipment, floor space, and manpower since the same equipment can be used to fabricate these members 40, 60. Alternatively, the members 40, 60 may be formed from pipe stock that may be purchased from pipe stock suppliers, and may require minimal or no custom fabrication.

The lift arm assembly 10 may include fewer welds and a lower total length of welds. For example, in exemplary embodiments, each of the tubular members 40 and the cross member 60 may have a continuous and seamless periphery, or a continuous periphery with a single longitudinal weld 48 or seam. That is, each of the tubular members 40 and the cross member 60 may have a continuous periphery and a maximum of one seam (zero or one). Thus, unlike other tubular members formed by plate steel that are welded together with multiple seams, the tubular members 40 and the cross member 60 of such embodiments may be formed with minimal welds, and only a maximum of one longitudinal weld extending the length of the respective members 40, 60. Also, as noted above, the tubular members 40, the castings 30, and the cross member 60 may be welded at the connection sections 70, 80, and the plate assemblies 50 may be welded to the respective tubular members 40. The welds that are provided in the connection sections 70, 80 may be stronger since the welds may be continuous along the periphery of the tubular members 40, the cross member 60, and/or the casting 30. Furthermore, the castings 30 may be formed from cast steel or other materials by the casting process without welding. As a result, the total length of welds for the lift arm assembly 10 and the weight of the lift arm assembly 10 may be reduced.

As noted above, the locations of the welds in the lift arm assembly 10 may be determined based on a stress analysis of the lift arm assembly 10. For example, an analysis of the fatigue life of the lift arm assembly 10 may indicate that there are higher stresses toward the middle (with respect to the longitudinal dimension of the arms 20) and front ends of the arms 20. Accordingly, the welds for connecting the plate assemblies 50 to the respective tubular members 40 may be located closer to the rear end 44 of the tubular member 40, e.g., between the rear end 44 and the middle of the tubular member 40, and away from the front of the tubular member 40 (corresponding to the middle of the arm 20) where the higher stresses calculated from the fatigue analysis may be located. Also, the tubular members 40 may extend along the rear and middle of the arms 20 so that the welds in the connection sections 70 may be located in a section of the arms 20 between the middle and front ends of the arms 20 (e.g., offset from the middle of the arms 20), away from where the higher stresses calculated from the fatigue analysis may be located. Furthermore, the welds in the connection sections 80 may be located away from the front ends of the arms 20, away from where the higher stresses calculated from the fatigue analysis may be located. As shown in the exemplary embodiment of FIG. 2, the castings 30 may include the middle section 38 extending generally laterally from the main section 32 of the casting 30 so that the welds connecting the castings 30 to the cross member 60 may be located away from the front ends of the arms where the higher stresses may be located.

The lift arm assembly 10 may include fewer components. As noted above, the tubular member 40 may replace more complicated conventional designs that involve welding together multiple sections of plate steel. Furthermore, as noted above, the castings 30 may be formed from cast steel or other materials with the casting process. As a result, the castings 30 may each replace as many as 29 parts included in certain conventional lift arm assemblies. For this additional reason, fabricating the lift arm assembly 10 may be less expensive, may require fewer steps, and may require less investment in terms of equipment, floor space, and manpower.

The lift arm assembly 10 may be stronger and more durable. The J-groove 72 shown in FIGS. 5 and 6 provides a built-in shelf for the weld to sit in and adhere to. Thus, the J-groove welds may provide a stronger and more durable connection. Also, as noted above, the castings 30 may be formed from cast steel or other materials with the casting process. The castings 30 may each replace as many as 29 parts that may be welded together in certain conventional lift arm assemblies. The casting 30 may be stronger and more durable than the welded plates, since components formed by the casting process may be stronger than a similar part that has been welded together. Also, the front ends of the arms 20 where the casting 30 is located may experience higher stresses. Thus, the fatigue life of the lift arm assembly 10 may be improved. As a result, by determining where to more efficiently place the welds using a stress analysis, the lift arm assembly 10 may be formed using parts formed by the casting process, which may be more expensive, and tubing, which may be more cost efficient and easier to fabricate, while maintaining strength and durability.

It will be apparent to those skilled in the art that various modifications and variations can be made to the lift arm assembly. Other embodiments will be apparent to those skilled in the art from consideration of the specification and practice of the disclosed lift arm assembly. It is intended that the specification and examples be considered as exemplary only, with a true scope being indicated by the following claims and their equivalents.

What is claimed is:

1. A lift arm assembly comprising:

a first arm casting including a first end;

a second arm casting including a first end;

a tubular cross member attached to the first arm casting and the second arm casting;

a first arm tubular member including a first end attached to the first end of the first arm casting; and a second arm tubular member including a first end attached to the first end of the second arm casting such that the second arm tubular member is generally parallel to the first arm tubular member, wherein the tubular cross member, the first arm tubular member, and the second arm tubular member have a continuous periphery, a maximum of one seam, and a substantially constant cross-section along substantially an entire length of the respective member, wherein the tubular cross member, the first arm tubular member, and the second arm tubular member have the same cross-section.

2. The lift arm assembly of claim 1, further including a plate assembly welded to at least one side of at least one of the first arm tubular member and the second arm tubular member.

3. The lift arm assembly of claim 2, wherein:

the first and second arm tubular members each include a second end opposite the first end; and the plate assembly is connected to at least one of the second arm tubular member and the first arm tubular member at a location generally between a middle and second end of the respective tubular member.

4. The lift arm assembly of claim 1, wherein:

a second end of at least one of the second arm tubular member and the first arm tubular member includes a connecting portion configured to connect to a frame of a machine; and the lift arm assembly is configured to pivot at least about the connecting portion.

5. The lift arm assembly of claim 1, wherein a second end of at least one of the second arm casting and the first arm casting includes a connecting portion configured to connect to an implement.

6. The lift arm assembly of claim 1, wherein:

the first arm casting includes a main section and a middle section extending generally laterally from the main section of the first arm casting, the main section of the first arm casting including the first end of the first arm casting;

the second arm casting includes a main section and a middle section extending generally laterally from the main section of the second arm casting, the main section of the second arm casting including the first end of the second arm casting; and the tubular cross member is attached to both middle sections of the first arm casting and the second arm casting.

7. The lift arm assembly of claim 1, wherein:

at least a portion of one of the second arm tubular member and the second arm casting is inserted into and welded to the other of second arm tubular member and the second arm casting; and at least a portion of one of the first arm tubular member and the first arm casting is inserted into and welded to the other of first arm tubular member and the first arm casting.

8. The lift arm assembly of claim 7, wherein the welds are J-groove welds.

9. The lift arm assembly of claim 7, wherein the second arm casting is inserted into the second arm tubular member, and the first arm casting is inserted into the first arm tubular member.

10. The lift arm assembly of claim 1, wherein:

the tubular cross member includes a first end and a second end;

at least a portion of one of the first end of the tubular cross member and the first arm casting is inserted into and welded to the other of the first end of the tubular cross member and the first arm casting; and at least a portion of one of the second end of the tubular cross member and the second arm casting is inserted into and welded to the other of the second end of the tubular cross member and the second arm casting.

11. The lift arm assembly of claim 1, wherein the tubular cross member, the first arm tubular member, and the second arm tubular member each include a piece of plate metal that is bent to form a generally rectangular cross-section and each include a single longitudinal weld along the respective member.

12. The lift arm assembly of claim 1, wherein:

the first arm casting and the first arm tubular member form a first arm of the lift arm assembly;

the first end of the first arm tubular member attaches to the first end of the first arm casting at a location that is offset longitudinally from a middle of the first arm;

the second arm casting and the second arm tubular member form a second arm of the lift arm assembly; and the first end of the second arm tubular member attaches to the first end of the second arm casting at a location that is offset longitudinally from a middle of the second arm.

13. The lift arm assembly of claim 1, wherein the tubular cross member, the first arm tubular member, and the second arm tubular member are formed from same size pipe stock.

14. A method of assembling a lift arm assembly, the method comprising:

providing a tubular cross member, a first arm tubular member, and a second arm tubular member from same size pipe stock;

attaching a first end of the tubular cross member to a first arm casting;

attaching a second end of the tubular cross member to a second arm casting;

attaching the first arm tubular member to the first arm casting;

attaching the second arm tubular member to the second arm casting such that the second arm tubular member is generally parallel to the first arm tubular member;

inserting at least a portion of one of the first arm tubular member and the first arm casting into the other of the first arm tubular member and the first arm casting; and inserting at least a portion of one of the second arm tubular member and the second arm casting into the other of the second arm tubular member and the second arm casting, wherein of the tubular cross member, the first arm tubular member, and the second arm tubular member has a continuous periphery, a maximum of one seam, and a substantially constant cross-section along substantially an entire length of the respective member, and wherein the tubular cross member, the first arm tubular member, and the second arm tubular member have the same rectangular cross-section.

15. The method of claim 14, wherein the tubular cross member, the second arm tubular member, and the first arm tubular member are each formed by bending a piece of plate metal to form the rectangular cross section and providing a single longitudinal weld along the respective member.

16. A machine comprising:

a frame;

a lift arm assembly pivotally coupled to the frame, the lift arm assembly comprising:

a first casting, a second casting, a first tubular member including a first end attached to the first casting and a second end attached to the frame, the first tubular member having a continuous periphery, a maximum of one seam, and a substantially constant cross-section along substantially an entire length of the first tubular member, at least a portion of one of the first tubular member and the first casting being inserted into and welded to the other of the first tubular member and the first casting, a second tubular member including a first end attached to the second casting and a second end attached to the frame, the second tubular member being generally parallel to the first tubular member, the second tubular member having a continuous periphery, a maximum of one seam, and a substantially constant cross-section along substantially an entire length of the second tubular member, at least a portion of one of the second tubular member and the second casting being inserted into and welded to the other of the second tubular member and the second casting, and a tubular cross member attached to the first casting and the second casting, the tubular cross member having a continuous periphery, a maximum of one seam, and a substantially constant cross-section along substantially an entire length of the tubular cross member, at least a portion of one of the tubular cross member and the first casting being inserted into the other of the tubular cross member and the first casting, at least a portion of one of the tubular cross member and the second casting being inserted into and welded to the other tubular cross member and the second casting; and an implement pivotally coupled to the first casting and the second casting, wherein the tubular cross member, the first tubular member, and the second tubular member have the same rectangular cross-section.

17. The machine of claim 16, wherein the lift arm assembly further includes a plate assembly welded to at least one side of at least one of the first tubular member and the second tubular member.

18. The machine of claim 16, wherein the tubular cross member, the first tubular member, and the second tubular member each include a piece of plate metal that is bent to form a generally rectangular cross-section and each include a single longitudinal weld along the respective member.

19. The machine of claim 16, wherein the tubular cross member, the first tubular member, and the second tubular member are formed from same size pipe stock.

* * * * *